US008220403B2

(12) United States Patent
Petersson

(10) Patent No.: US 8,220,403 B2
(45) Date of Patent: Jul. 17, 2012

(54) METHOD OF FASTEN THREADS AT BUTTONS AND MEANS FOR MAKING THE SAME

(76) Inventor: Bengt Petersson, Vallda (SE)

( * ) Notice: Subject to any disclaimer, the term of this patent is extended or adjusted under 35 U.S.C. 154(b) by 362 days.

(21) Appl. No.: 12/515,592

(22) PCT Filed: Dec. 4, 2007

(86) PCT No.: PCT/SE2007/050938

§ 371 (c)(1),
(2), (4) Date: Jun. 1, 2009

(87) PCT Pub. No.: WO2008/069746

PCT Pub. Date: Jun. 12, 2008

(65) Prior Publication Data

US 2010/0058965 A1 Mar. 11, 2010

(30) Foreign Application Priority Data

Dec. 7, 2006 (SE) ..... 0602624

(51) Int. Cl.
*D05B 3/14* (2006.01)

(52) U.S. Cl. ..... 112/475.15

(58) Field of Classification Search ..... 112/475.15, 112/475.01, 475.09, 475.14; 24/90.1, 378.1, 24/379.1

See application file for complete search history.

(56) References Cited

U.S. PATENT DOCUMENTS 2,451,077 A * 10/1948 Emsig ..... 24/114.7
3,390,434 A * 7/1968 Snyder ..... 24/114.7
3,440,984 A * 4/1969 Hofe ..... 112/110
3,816,200 A * 6/1974 McKenna ..... 156/93
4,120,054 A * 10/1978 Lemelson ..... 2/265
4,854,252 A * 8/1989 Asao et al. ..... 112/475.15
6,319,547 B1 * 11/2001 Li ..... 427/140

* cited by examiner

*Primary Examiner* — Tejash Patel
(74) *Attorney, Agent, or Firm* — Potomac Patent Group PLLC

(57) ABSTRACT

The present invention relates to a method to, using self-vulcanizing material in the form of a narrow tape or thread (1), wind the tape or thread (1) around the sewing thread (7) of the sewed-on button (3) between the button (3) and a textile (2) in question a few turns, and after that, tear off the tape or thread (1). The remaining tape or thread (1) is pressed together using a pliers-like hand tool (4) into a soft neck (10), which within approx. two hours has been vulcanized together. Then, the sewing thread (7) does not unwind and the button (3) stably stays in place. The invention also relates to a means for carry out the method.

12 Claims, 2 Drawing Sheets

METHOD OF FASTEN THREADS AT BUTTONS AND MEANS FOR MAKING THE SAME

The present invention relates to a method of fastening and retaining sewing thread of sewed-on buttons in textiles and simultaneously forming a neck between the button and the textile.

Methods of fastening and retaining the sewing thread on sewed-on buttons, garments and other textiles so that the buttons do not come loose and that simultaneously form a soft neck between the button and the textile with a desired height are previously known. By, for instance, U.S. Pat. No. 747,047 A, examples are shown of how a button is sewed on and a thread neck is formed. However, this manufacture is complicated and requires many threads, which also becomes expensive. The problem, which is well-known, that the buttons come loose in garments, for instance, outdoor clothes, shirts and blouses has also been solved in other ways. On the market, there is a system for, by means of a machine, winding a textile thread around the sewing thread that holds the button. That thread is partly of fusible material and requires a tool that is electrically heated but that may damage sensitive fabrics. That equipment is complicated and expensive, and requires much service. It means that the investment for the industry becomes so significant that the price of a garment increases considerably. Facing said shortcomings, the industry demands a simpler and safer as well as a more inexpensive system that does not require investment in an expensive equipment.

Therefore, the main object of the present invention is, among other things, to solve said problem in a simple, efficient and cost-saving way.

Said object is attained by means of a method according to the present invention that essentially is characterized in that a self-vulcanizing tape or a thread is extended to approximately the double original length thereof and which then begins to self-vulcanize, and after that, the same is wound a number of turns around the sewing thread between the button and the textile, preferably the accumulation of sewing threads and self-vulcanizing tapes, etc., being pressed together for the formation of a soft neck.

An additional object of the invention is to provide means to be utilized when carrying out a said method.

By, among other things, U.S. Pat. No. 1,909,455 A, it is previously known that rubber material that is allowed to vulcanize by simply acting on the material so that it is subjected to dimensional change, by pulling the material so that it is extended in relation to the original length thereof.

A said additional object is attained by means of means according to the present invention that essentially is characterized in that it comprises a tape or thread that consists of self-vulcanizing material and that is arranged to start the vulcanization upon tension load, and preferably also a tool that is arranged to be used to press together material into an even surface, preferably at room temperature.

Figure 1:
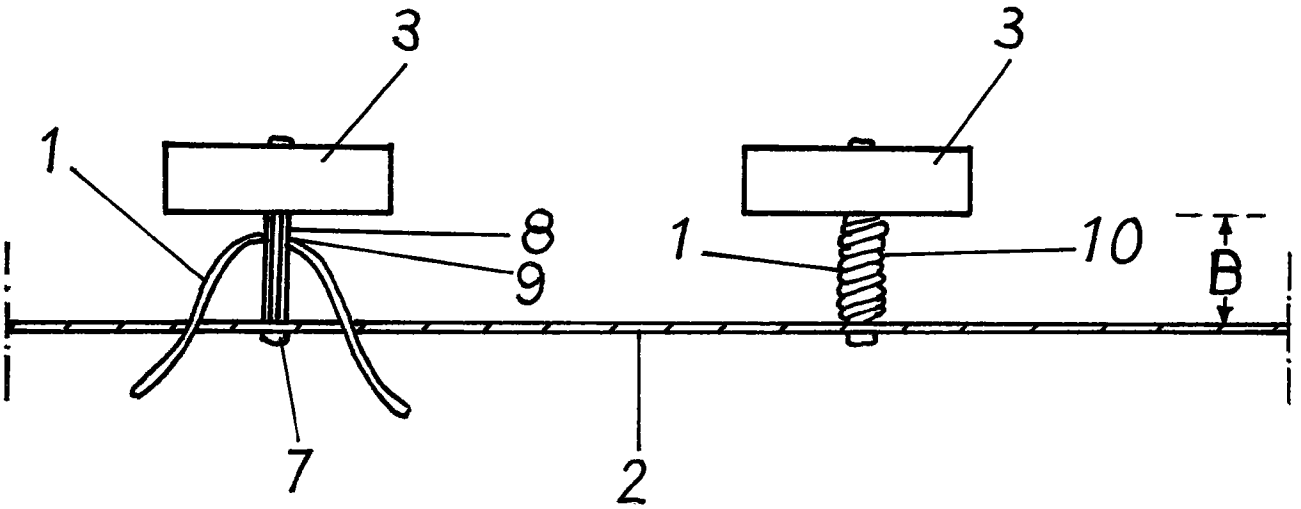
Figure 1A:
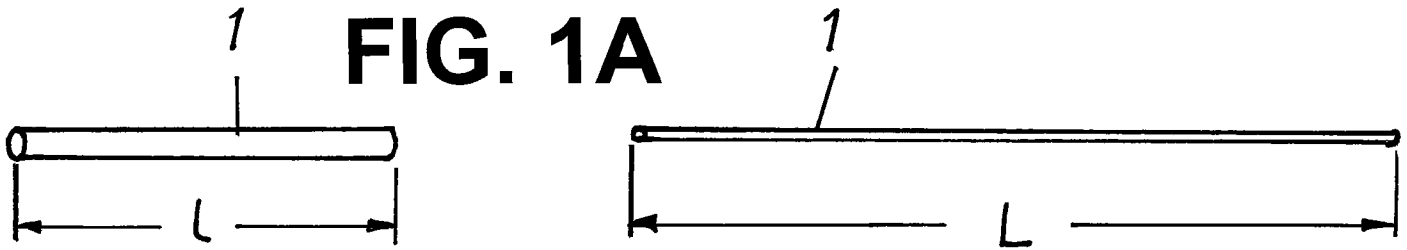
Figure 2:
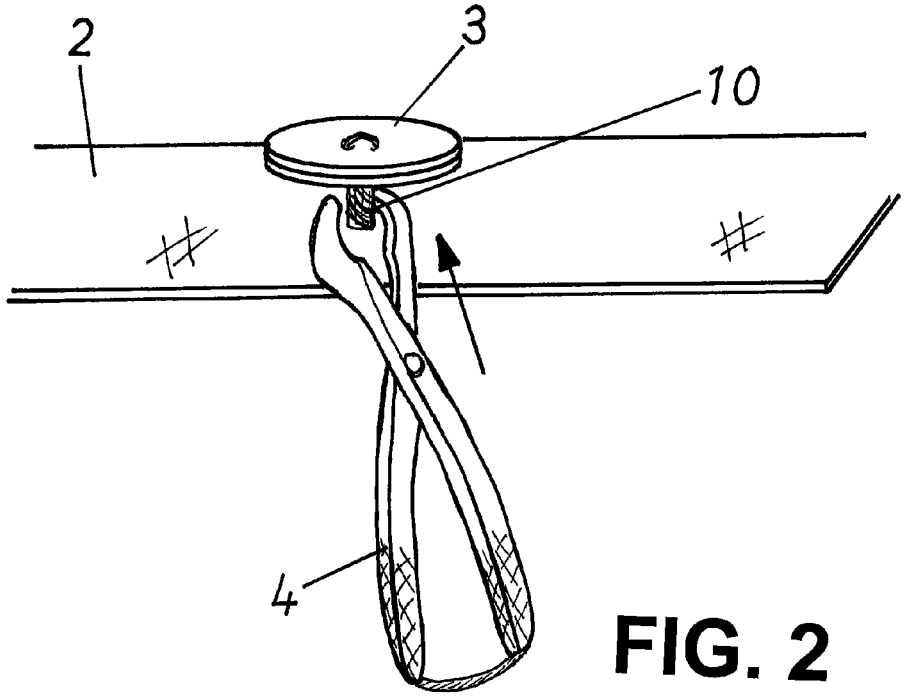
Figure 3:
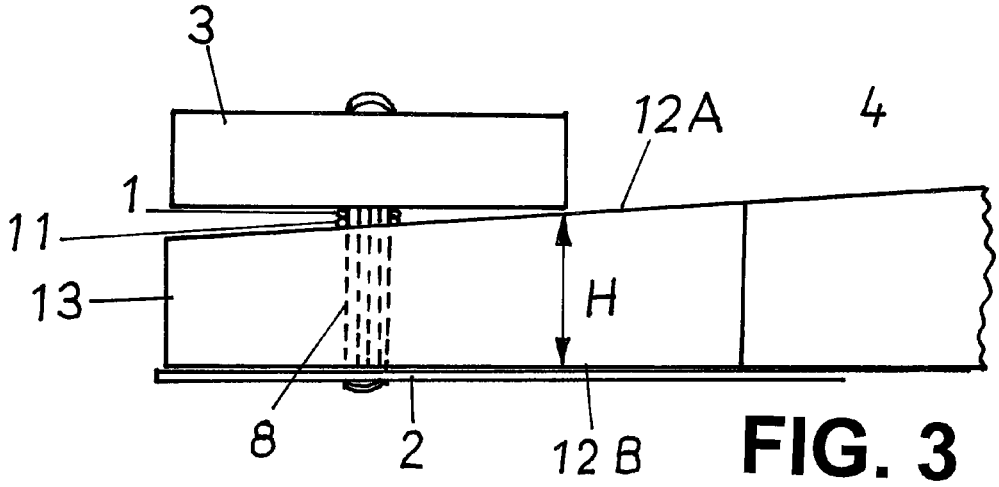

The invention is described in the following, reference being made to the accompanying drawings in which FIG. 1 schematically shows the fastening of thread to a pair of buttons and at different stages, FIG. 1A shows tape extension, FIG. 2 shows a tool that is used upon the fastening of thread, and FIG. 3 shows a section view of the jaw of the tool as an example.

The simple method according to the present invention does not require any complicated equipment but it is possible to manually wind the self-vulcanizing thread or tape around the sewing thread that holds the sewed-on button a few turns between the button and the textile in a second, and then by the hand tool, fast and efficiently shape the wound-on self-vulcanizing thread or tape into a soft neck. In addition, the method is suitable for tailors to easily secure the button fastening. The self-vulcanizing material in the tape or thread begins to self-vulcanize when the tape or thread is extended to approximately the double length thereof, which then, after the extension of the tape or thread to the double length thereof, is wound a few turns around the sewing thread that forms the neck between the button and the textile. Next, the tape or thread is torn off by a small manual force and then, by using the pliers-like tool, the wound-on remaining self-vulcanizing material is pressed together into a soft neck, which within approximately two hours has been vulcanized together. The buttons are thereby fixed without risking coming loose because of the thread would come undone. Garments that have been provided with buttons according to the new method can without problems be washed in 60° C. and tumble-dried. Thanks to a self-vulcanizing tape or thread that is wound around the sewing thread, the sewing thread does not unwind and the button thereby stays in place.

In more detail, a method of fastening and retaining a sewing thread 7 of sewed-on buttons 3 in textiles 2 and simultaneously for the formation of a neck 8 extending between the button 3 and the textile 2 comprises the extension of a self-vulcanizing tape or a thread 1 to approximately the double original length thereof from the length 1 to the length L, the tape/thread 1 then beginning to self-vulcanize. Next, the tape/thread 1 is wound a desired a number of turns around the sewing thread 7 and the thread neck 8 formed thereby between the sewed-on button 3 and the textile 2. Next, the accumulation 9 of sewing thread and self-vulcanizing tape, etc., 1 is preferably pressed together for the formation of a soft neck 10.

More precisely, the self-vulcanizing tape/thread 1 is wound around the sewing thread a few turns 11 directly after the tape/thread 1 has been pulled out to at least the double length thereof L in relation to the original length 1 thereof. Then, the accumulation 9 of sewing thread 7 and self-vulcanized tape/thread 1 is pressed together by means of a handheld tool 4, preferably a pair of tweezers or a pliers-like hand tool. The method may be effected entirely mechanically or manually or by a combination thereof. The accumulation 9 of sewing thread 7 and vulcanizing tape/thread 1 may, e.g., be pressed together using the fingers, but is most efficient to utilize a hand tool 4 or an automatic machine both for the vulcanization and for the pressing-together after automatic sewing on of a button in a machine where a desired distance B between the button 3 and the textile 2 is provided.

Means for carrying out a method of fastening and retaining sewing thread 7 for sewed-on buttons 3 in textiles 2 and simultaneously forming a soft neck 10 between the button 3 and the textile 2 comprises a tape or thread 1 that consists of a self-vulcanizing material, preferably a rubber material or the like, and that is arranged to start the vulcanization after tension load of the material. It preferably also comprises a tool 4 arranged to press together the material in question into an even surface, then, preferably at normal room temperature, e.g., between 20-30° C. or higher.

Said self-vulcanizing material in the tape/thread 1 is arranged to start the vulcanization immediately after it has been extended to at least the double length L thereof and that it is arranged to be completely vulcanized after approximately two hours.

The tool 4 in question consists of a hand tool 4 in the form of a pair of pliers, the jaws 5 of which have a height H adapted to the desired intended button thread neck 8 formed. At least one side 12, 12B of the jaws 5 of the pliers 4 has an inclined shape, converging toward the tip 13 thereof. Preferably, the jaws 5 of the pliers 4 are spring-force actuated 6 to be kept apart. The jaws 5 of the pliers 4 have a curved or plane shape, along the forming portion thereof, for instance crescent-shaped.

When the jaws 5 are pressed together by the hand tool 4 around the self-vulcanizing material in the tape or thread 1 located around the sewing thread 7 holding the button 3, then a soft neck 10 has thereby been provided and that holds the sewing thread 7 so that it cannot unwind and the button 3 comes loose.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A method of fastening and retaining sewing thread of sewed-on buttons in textiles and simultaneously forming a neck between a button and a textile, comprising:

extending a self-vulcanizing material to approximately double an original length thereof, which then begins to self-vulcanize, then winding the self-vulcanizing material a number of turns around the sewing thread between the button and the textile directly after the self-vulcanizing material is extended to double its original length, and pressing accumulated sewing thread and self-vulcanizing material together to form a soft neck.

2. The method of claim 1, wherein the self-vulcanizing material is a tape or a thread.

3. The method of claim 1, wherein the accumulated sewing thread and self-vulcanizing material is pressed together by a hand tool.

4. The method of claim 3, wherein the hand tool is a pair of tweezers or a pliers-like tool.

5. An apparatus for fastening and retaining sewing thread of sewed-on buttons in textiles and simultaneously forming a neck between a button and a textile according to the method of claim 1, comprising:

a self-vulcanizing material that is arranged to start vulcanization upon application of a tension load and, and that is wound around the sewing thread a plurality of turns directly after the material is extended to approximately double its original length, and a tool for pressing together material into an even surface.

6. The apparatus of claim 5, wherein the self-vulcanizing material is a tape or a thread.

7. The apparatus of claim 5, wherein the self-vulcanizing material is arranged to start vulcanization immediately after the tension load has extended it to double its original length.

8. The apparatus of claim 5, wherein the self-vulcanizing material is arranged to be completely vulcanized after approximately two hours.

9. The apparatus of claim 5, wherein the tool is a pair of pliers having jaws that have a height adapted to form a desired neck.

10. The apparatus of claim 9, wherein at least one side of the jaws has an inclined shape converging toward a tip thereof.

11. The apparatus of claim 9, wherein the jaws are kept apart by a spring force.

12. The apparatus of claim 9, wherein the jaws have either a curved shape or a planar shape.

* * * * *